US010682535B2

(12) United States Patent
Chabod et al.

(10) Patent No.: US 10,682,535 B2
(45) Date of Patent: Jun. 16, 2020

(54) SELF-LOCKING DESCENDER

(71) Applicant: ZEDEL, Crolles (FR)

(72) Inventors: Pierre-Olivier Chabod, Pontcharra (FR); Christophe Quillard, Eybens (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 15/834,748

(22) Filed: Dec. 7, 2017

(65) Prior Publication Data

US 2018/0154190 A1 Jun. 7, 2018

(30) Foreign Application Priority Data

Dec. 7, 2016 (FR) ..... 16 62086

(51) Int. Cl.
*A62B 1/14* (2006.01)

(52) U.S. Cl.
CPC ..... *A62B 1/14* (2013.01)

(58) Field of Classification Search
CPC ..... A62B 1/14
See application file for complete search history.

(56) References Cited

U.S. PATENT DOCUMENTS

| | | | | |
|---|---|---|---|---|
| 2009/0120720 | A1* | 5/2009 | Arms | A62B 1/14 182/193 |
| 2014/0262611 | A1* | 9/2014 | Oddou | A62B 1/14 182/5 |
| 2016/0228730 | A1* | 8/2016 | Chaumontet | A62B 1/14 |
| 2017/0189725 | A1* | 7/2017 | Malcolm | A63B 29/02 |
| 2018/0154190 | A1* | 6/2018 | Chabod | A62B 1/14 |

FOREIGN PATENT DOCUMENTS

| | | | | |
|---|---|---|---|---|
| EP | 2 777 772 | A2 | 9/2014 | |
| FR | 2721523 | A1 | 12/1995 | |
| WO | 2015/071626 | A1 | 5/2015 | |
| WO | WO-2015071626 | A1 * | 5/2015 | A62B 1/14 |

* cited by examiner

*Primary Examiner* — Katherine W Mitchell
*Assistant Examiner* — Candace L Bradford
(74) *Attorney, Agent, or Firm* — Oliff PLC

(57) ABSTRACT

A rope self-locking descender has a first flange, a cam movable with respect to the first flange successively between a first position, a clamping position of the rope and a running position of the rope in the first flange, a handle movable with respect to the first flange successively between a stowing position, a first position of use clamping the rope and a running position of the rope. A first spring is connected to the first flange and to the handle to return the handle to the stowing position. The cam is mechanically connected to the handle in intermittent manner so that movement of the cam from the first position to its clamping position of the rope results in movement of the handle from its stowing position to the first position of use. The handle is not mechanically connected to the cam between the first position and a running position.

6 Claims, 8 Drawing Sheets

SELF-LOCKING DESCENDER

BACKGROUND OF THE INVENTION

The invention relates to a self-locking descender on a rope.

The invention also relates to a method for using such a self-locking descender.

STATE OF THE ART

When performing rope access work, the rope access technician moves along a rope between different work stations. In conventional manner, the rope access technician descends along the rope until he reaches his work station. The rope access technician then clamps the rope inside the descender so as to be able to perform the different operations related to the work station.

As the rope access technician is installed at height, it is necessary to proceed carefully in order not to compromise his safety by releasing clamping of the rope.

In conventional manner, the descender comprises a clamping position where the rope is clamped inside the descender. This position is used when the rope access technician is at his work station. The descender also comprises a descent position in which the rope can slide inside the descender thereby allowing the user to descend along the rope.

In conventional manner, the descender comprises a first flange which defines a running path of the rope in the descender.

The descender also comprises a cam which moves inside the first flange and which comes into contact with the rope in order to clamp the latter inside the descender or to modulate a friction force allowing sliding of the rope inside the descender.

The handle is mechanically connected to the cam either directly or indirectly so that rotation of the handle with respect to the first flange causes movement of the cam between its position clamping the rope and a position allowing sliding of the rope.

When the rope access technician is working at his work station, he uses a number of tools which may unintentionally interact with the descender.

In order to reduce this type of risk, work is being carried out on the shape of the descender in order to limit the possibilities of interactions with the other tools used by the rope access technician. Some descenders present a handle which can move between several positions of use and in particular a stowing position, a clamping position, a belay position and a descent position. Movement from one position of use to another position of use is performed by the user. It is apparent that the ergonomy of use of the descender can be improved.

It is also known to manufacture descenders which have a position called "antipanic" position. These descenders are configured so that the handle is mechanically engaged with the cam up to a threshold value when the user is descending. In other words, the user applies a pressure on the handle to modulate the friction against the rope, and if the user reaches a threshold value for which the friction force may be insufficient to descend in complete safety, the handle escapes and loses the mechanical connection with the cam. The cam reverts to its clamping position of the rope.

Such a teaching is presented in the document WO2015/071626 which discloses a descender where the handle can be reset by continuing its travel and define a circle. The travel of the handle makes it possible to return to its initial position where the mechanical connection between the cam and handle exists in order to resume the descent.

A substantially equivalent teaching is present in the document EP2777772 where the handle is provided with a disengagement mechanism which disengages the mechanical connection with the cam so that the cam reengages the camming surface to clamp the rope.

However, such a solution is not satisfactory as this does not reduce the risk of having a piece of equipment which interacts with the handle of the descender causing an involuntary descent.

It is also known to manufacture a descender where the cam can be locked to obtain permanent clamping of the rope. Such a teaching can be found in the document FR2721523.

OBJECT OF THE INVENTION

The object of the invention is to provide a self-locking descender which is easier to use in order to make the descender more reliable.

The self-locking descender is remarkable in that it comprises:

- a first flange,
- a cam mounted movable with respect to the first flange successively between a first position, a clamping position of the rope and a running position of the rope in the first flange,
- a handle mounted movable with respect to the first flange successively between a stowing position, a first position of use clamping the rope and a descent position which allows running of the rope,
- a first spring connected to the first flange and to the handle so as to bias the handle to the stowing position.

It is advantageous to provide for the cam to be mechanically connected to the handle so that movement of the cam from the first position to its clamping position of the rope results in movement of the handle from its stowing position to the first position of use. It is also preferable to provide for the handle not to be mechanically connected to the cam between the first position of use clamping the rope and a descent position.

In one development, the handle is mounted movable in rotation with respect to the first flange. The first position of use of the handle is located on one side of the descender and the descent position of the handle is located on the other side of the descender. The two sides are separated by inlet and outlet openings of the rope in the descender.

In advantageous manner, the first position of use clamping the rope and the descent position are separated by an angle at least equal to 90°.

Preferentially, the first position of use clamping the rope and the descent position are separated by an angle at least equal to 120°.

In a particular embodiment, the cam and handle are separated by the first flange.

In an alternative embodiment, the cam has a salient pin operating in conjunction with a stop of the handle, the stop presenting opposite first and second surfaces. The pin is in contact with the first surface of the stop when the cam is between the first position and the clamping position of the rope.

In preferential manner, the pin is in contact with the second surface of the stop when the handle is in the descent position.

In another advantageous embodiment, the pin does not make any contact with the stop when the handle is located between the first position of use clamping the rope and a descent position.

In another development, the pin passes through the first flange. Movement of the pin is demarcated by an opening having opposite first and second ends, the pin being in contact with the first end when the handle is in the stowing position.

It is a further object of the invention to provide a method for using a self-locking descender which is easier to implement.

The method for using a self-locking descender is remarkable in that it comprises:

- providing a descender according to one of the different embodiments presented in the foregoing,
- inserting a rope in the first flange so as to move the cam from a stowing position to a clamping position of the rope, movement of the cam causing movement of the handle from a stowing position to a first position of use clamping the rope,
- moving the handle from its first position of use clamping the rope to a descent position, the cam not being mechanically connected to the handle during said movement.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

As illustrated in FIGS. 1 to 8, the self-locking descender comprises a first flange 1 and a cam 2 which is mounted on the first flange 1. The cam 2 is mounted movable on the first flange 1 and in preferential manner movable in rotation which facilitates manufacturing of the descender and use of the cam 2. However, as an alternative, it is possible to provide for the movement of the cam 2 with respect to the first flange 1 to be different from a rotation or to comprise a rotation and another movement. In the illustrated embodiment, the cam 2 is mounted movable around the swivel pin 2*a*. As illustrated in the different figures, the first flange 1 defines a running path of the rope 3 by means of a side wall so that the rope 3 runs around the cam 2, more precisely between the cam 2 and the side wall of the first flange 1.

Figure 4:
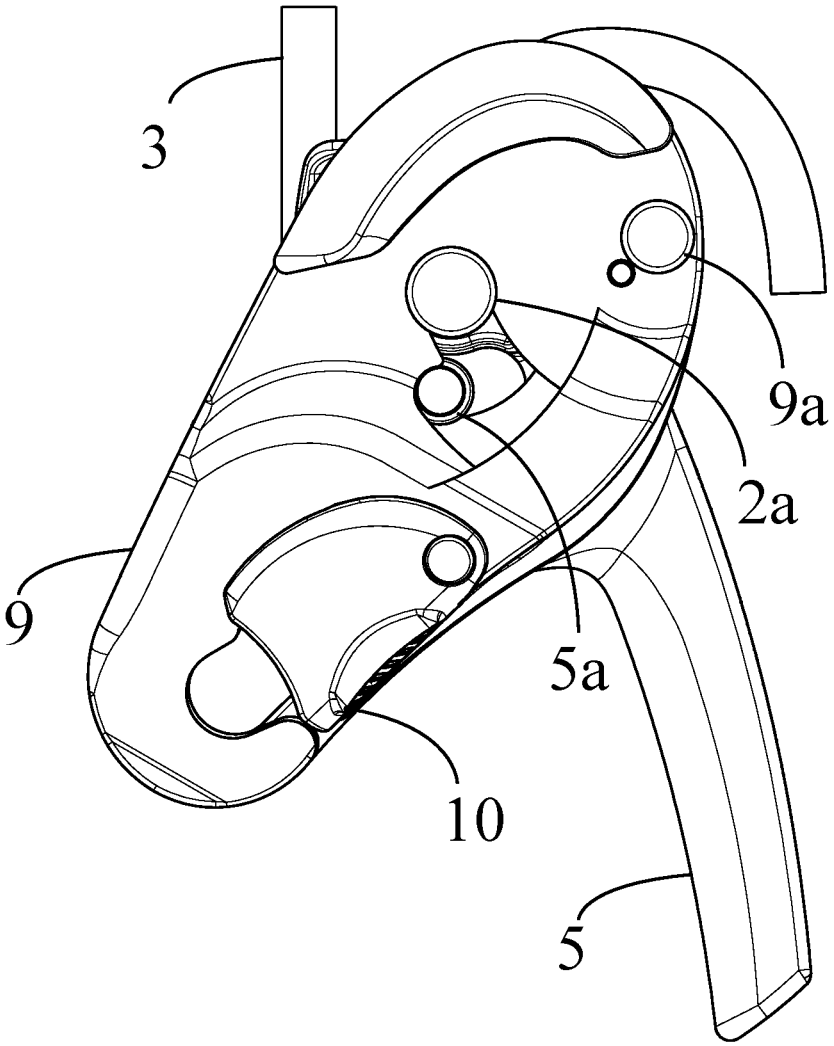
FIG. 4 represents, in schematic manner, a top view of a closed descender with insertion of the rope, the handle being in a first position clamping the rope.
Figure 5:
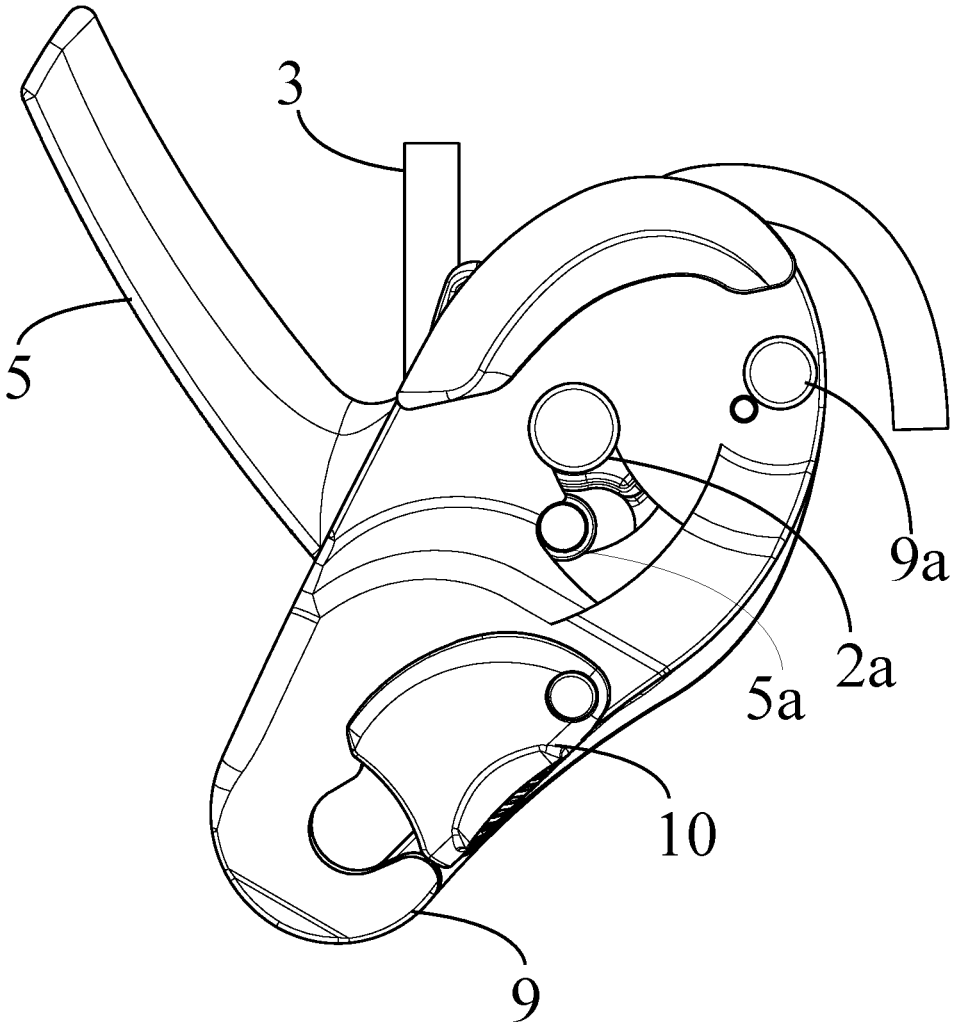
FIG. 5 represents, in schematic manner, a top view of a closed descender with insertion of the rope with the handle in a descent position.
Figure 6:
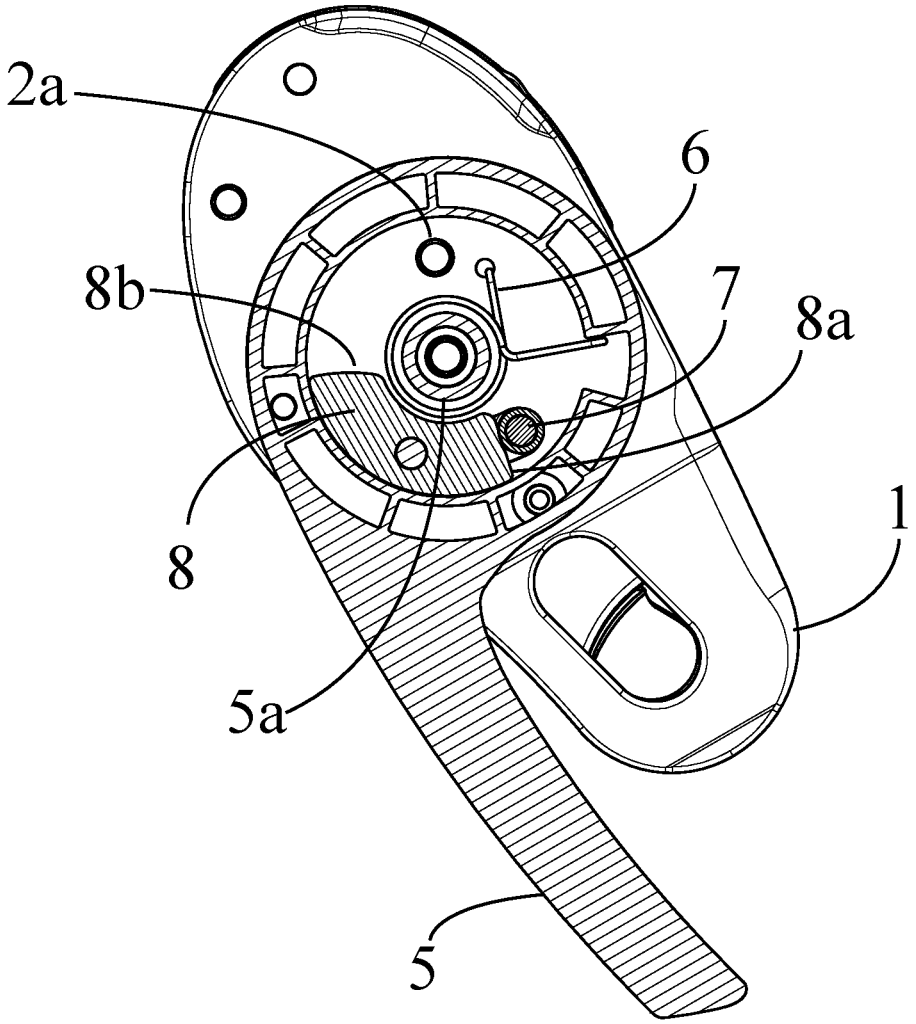
FIG. 6 represents, in schematic manner, a sectional view of a descender showing the handle in its stowing position.
Figure 7:
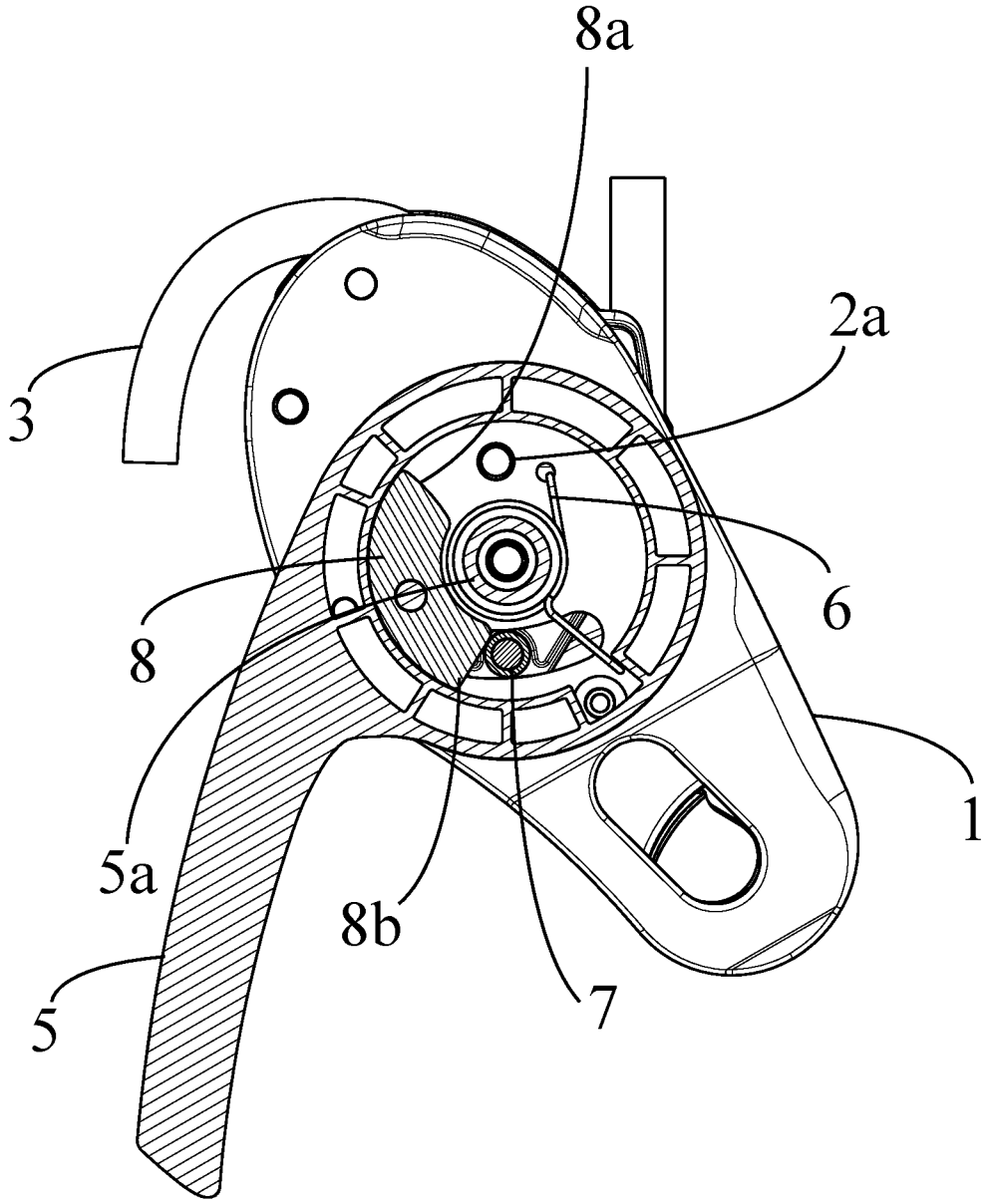
FIG. 7 represents, in schematic manner, a cross-section of a descender showing the handle in the position clamping the rope.
Figure 8:
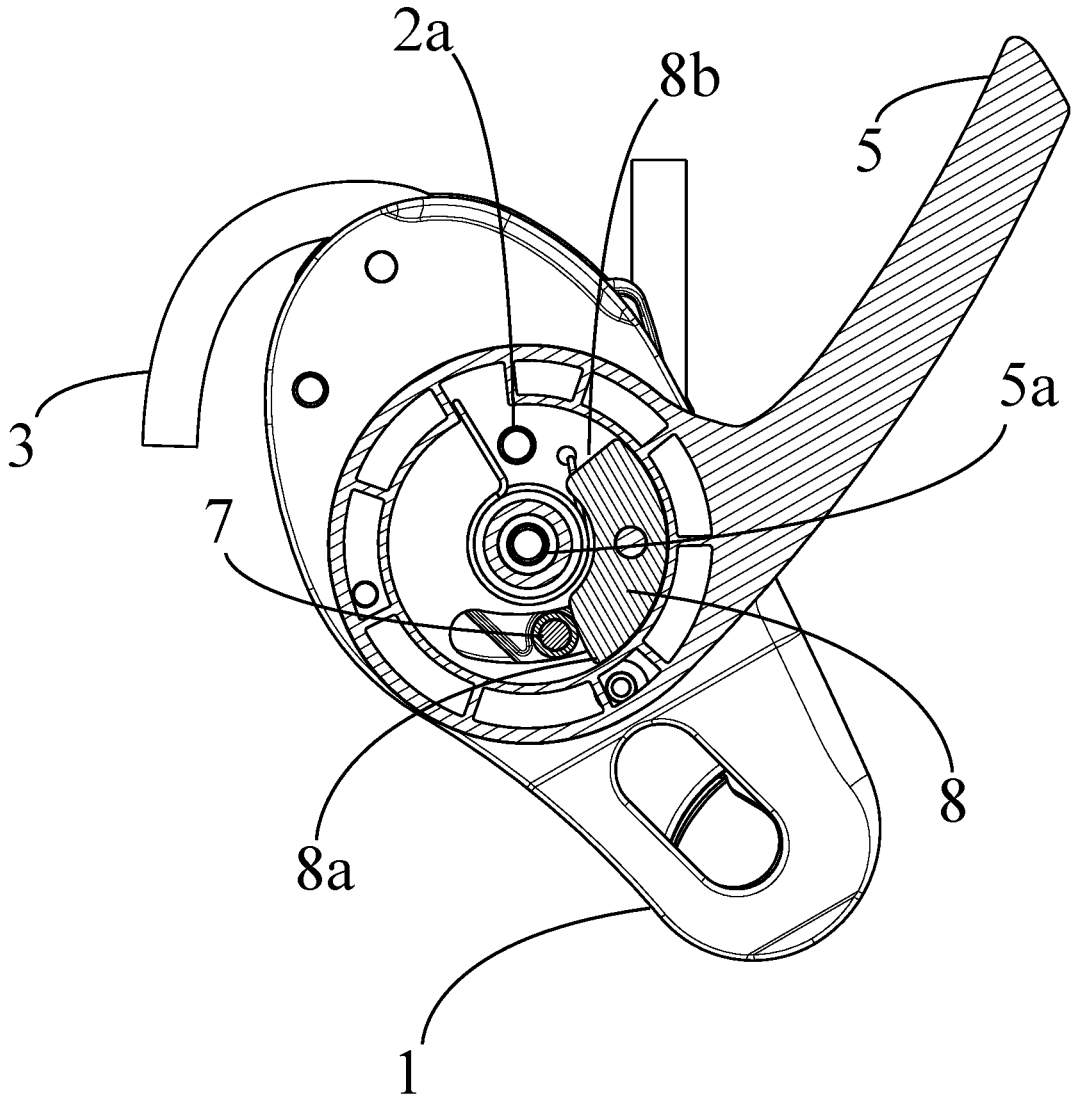
FIG. 8 represents, in schematic manner, a cross-section of a descender showing the handle in the position of use which allows movement of the rope in the descender.

In its movement, the cam 2 moves successively between a first cam position, a second cam position called clamping position of the rope 3, and a third cam position called descent position allowing running of the rope 3 in the first flange 1. The first cam position is a stowing position where the rope 3 has not yet been fitted in the descender and which corresponds to FIGS. 1, 2 and 6. The descent position is a position allowing the user to descend along the rope and therefore allowing sliding of the rope against the cam 2. The descent position is illustrated in FIGS. 5 and 8. The clamping position is illustrated in FIGS. 3, 4, 5 and 7

Figure 1:
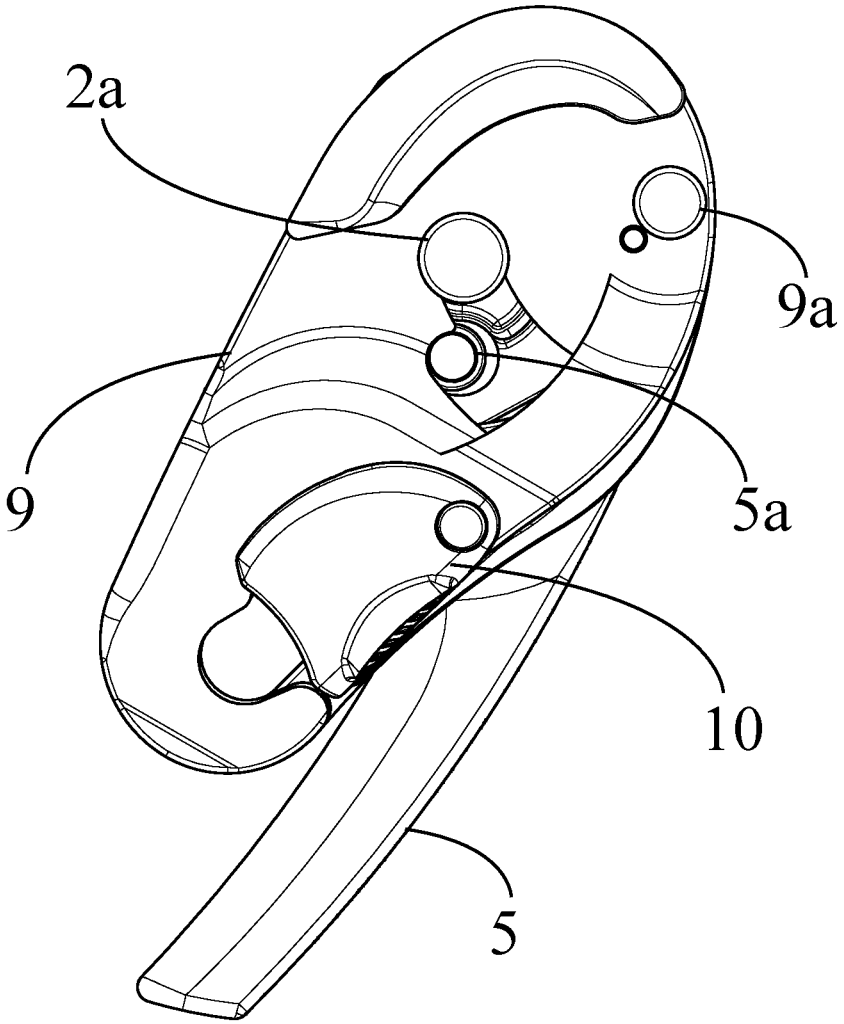
FIG. 1 represents, in schematic manner, a top view of a closed descender in the stowing position.
Figure 2:
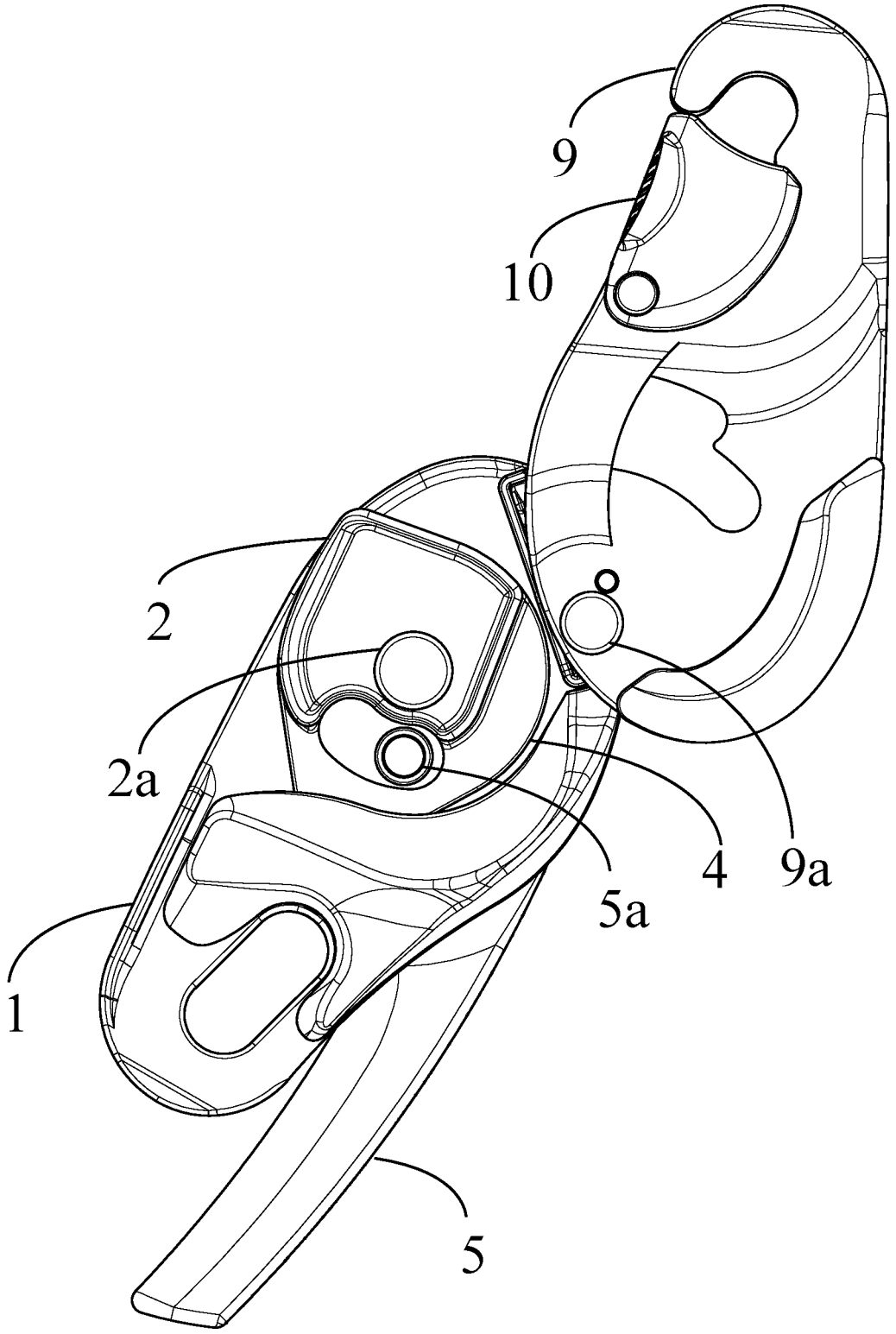
FIG. 2 represents, in schematic manner, a top view of an open descender in the stowing position.
Figure 3:
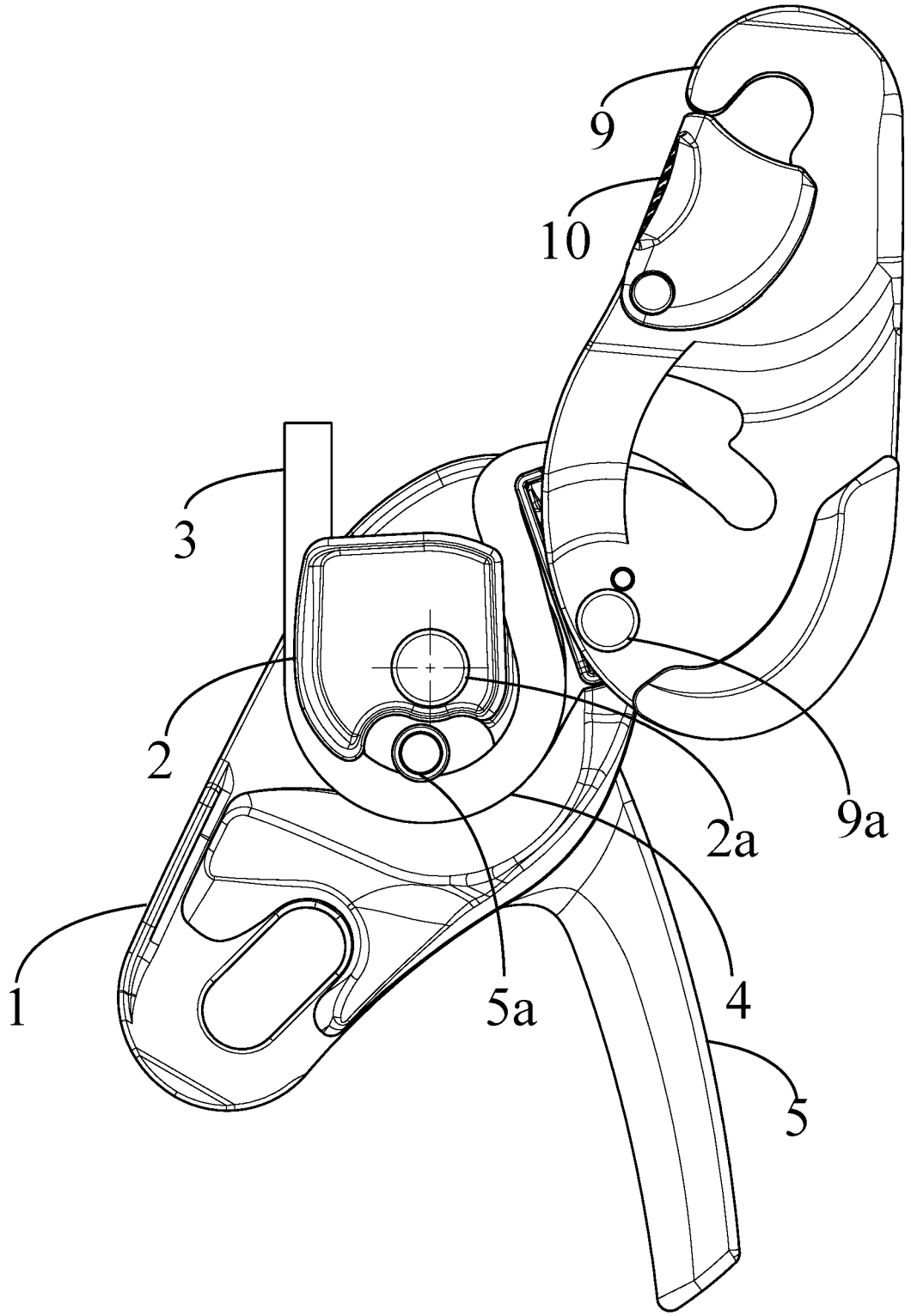
FIG. 3 represents, in schematic manner, a top view of an open descender with insertion of the rope, the handle being in a first position clamping the rope.

In a first direction of movement of the cam represented in FIGS. 2 and 3, the cam 2 moves from the first cam position to the clamping position of the rope 3 and then to the descent position. In advantageous manner, movement of the cam 2 in the opposite direction is also possible. The first, second and third successive cam positions represent three increasing distances between a side wall of the first flange 1 and a side wall of the cam 2. Advantageously, the first cam position corresponds to the minimum distance between the side wall of the cam and the side wall of the first flange 1 forming the running path of the rope 3.

It is advantageous to provide several descent positions of the cam 2 which allow running of the rope 3 in the first flange 1, i.e. sliding of the rope 3. It is therefore possible to have several descent positions allowing running of the rope 3 in the first flange 1. The different descent positions are associated with different friction forces of the cam 2 against the rope 3 which represents different abutment forces of the cam 2 against the rope 3 which is clamped against a side wall 4 of a running path of the rope 3 in the first flange 1. These different friction forces represent different distances between the side wall of the first flange 1 and the side wall of the cam 2

In an advantageous embodiment illustrated in FIGS. 2 and 3, modulation of the intensity of the friction forces is performed in continuous manner by modifying the shape of the side wall of the cam 2 in order to adjust the space which exists between the side wall of the cam 2 and the side wall 4 of the running path defined by the first flange 1.

The descender further comprises a handle 5 which is mounted movable with respect to the first flange 1. The handle 5 is mounted successively movable between a stowing position, a first position of the handle called position of use clamping the rope 3 and a second position of the handle called descent position allowing running of the rope 3.

In a first direction of movement illustrated by FIGS. 2, 3 and 5 and 6, 7 and 8, the handle 5 moves from the stowing position to the first position of use clamping the rope 3 and to the descent position allowing running of the rope 3. In advantageous manner, movement of the handle 5 in the opposite direction is also possible.

The descender also comprises a first spring 6 connected to the first flange 1 and to the handle 5 so as to return the handle 5 to the stowing position. The spring 6 is illustrated in FIGS. 6, 7 and 8. The spring 6 is illustrated by a torsion spring as this embodiment is particularly efficient and compact. Another type of spring can however be used.

It is particularly advantageous to use a spring 6 in order to move the handle away from the descent position and possibly to return the handle 5 to the stowing position as this enables the handle 5 to be protected when it is not used. The handle 5 being a salient element of the descender to facilitate use of the descender, it can be in flexion when it opens inside a bag. In the event of an impact, the handle 5 may be broken which makes the descender unusable. By returning the handle 5 to the clamping position, the distance to be covered to reach the descent position is greater which increases the safety of the clamping position.

As an alternative, an intermediate fixing point of the handle 5 can be formed along the path of movement of the handle 5 to clamp the handle 5 between the descent position and the first position in particular when the user releases his grip on the handle 5. This embodiment means that the user does not have to look for the handle 5 later on to engage a descent along the rope.

In the course of use, the handle 5 of the descender may also get jammed in a rope or in a tool which hampers the technician's work. By setting the handle 5 to its clamping position, the risks of jamming are reduced.

It is particularly advantageous, in the stowing position, to provide for the handle 5 to come into contact or to be aligned with the outer side wall of the first flange 1. In a particularly advantageous embodiment, the outer side wall of the handle 5 comes into contact with the outer side wall of the first flange 1 or is aligned with the outer side wall of the first flange 1. It is advantageous to provide for the shape of the outer wall of the handle to follow the shape of the first flange when the handle is in its stowing position. This configuration reduces the risks of unwanted actuation of the handle 5.

It is advantageous to provide for the cam 2 to be mechanically connected to the handle 5 in intermittent manner. The intermittent mechanical connection is configured so that a movement of the cam 2 from the first cam position to its clamping position of the rope 3 results in a movement of the handle 5 from its stowing position to the first position of use as illustrated in FIGS. 1, 2, 3 and 4.

In this case, when the rope 3 is inserted in the descender, inside the running path of the first flange 1, the rope 3 displaces the cam 2. The cam 2 moves from its first position to its clamping position of the rope 3 which causes movement of the handle 5. The shape of the cam 2 is configured to clamp the rope 3 against the side wall 4 and advantageously to progressively increase the restraining force as the tension in the rope increases for example following suspension of the user by means of the descender. The shape of the cam 2 is configured to be self-locking.

This configuration is particularly advantageous, as the rope 3 is automatically clamped when it is inserted in the descender. For example purposes, the document EP2777772 shows that installation of the rope in the descender does not have any effect on movement of the handle so that the user cannot know at a glance whether a mistake was made in the diameter of the rope. The same is the case for the document WO2015/071626.

As the cam 2 and handle 5 are mechanically connected, movement of the cam 2 results in movement of the handle 5 which leaves the stowing position for the first position of use which clamps the rope 3. By observing the movement of the handle 5, the user establishes that the rope 3 is correctly fitted in the descender. This also makes it possible to check that a rope 3 with a sufficient diameter has been inserted in the descender. If the diameter is too small, the handle 5 does not move, which indicates that clamping of the rope 3 will not take place or will be insufficient.

In a particular embodiment, the mechanical connection between the cam 2 and handle 5 is a one-way connection so that movement of the cam 2 results in movement of the handle 5 in a first direction from the stowing position to the first position clamping the rope 3. For example, a force applied on the handle 5 can prevent insertion of the rope in the first flange 1.

In an opposite second direction, movement of the cam 2 from the clamping position to the first position does not cause movement of the handle 5. Movement of the handle 5 is imposed by the spring 6 and limited by the cam 2. On the other hand, movement of the handle 5 to the stowing position causes movement of the cam 2 in the second direction and advantageously only in the second direction. In other words, movement of the handle 3 in the second direction can be clamped by the cam 2 on account of the rope 3. In advantageous manner, movement of the handle 5 from the stowing position to the first position of the handle does not result in movement of the cam which then remains in the first cam position 2.

In the first position of use, the spring 6 exerts a force which tends to return the handle 5 to the stowing position which results in application of a force on the cam 2 forcing clamping of the rope 3. In this way, safety is enhanced when the user is not using the descender, i.e. when he/she does not use the handle 5. This also makes it possible to add a force on the cam 2 by pressing on the handle 5, which increases the clamping force applied by the cam 2.

Advantageously, the mechanical connection between the handle 5 and cam 2 is configured so that the handle 5 is not mechanically connected to the cam 2 between the first position of use clamping the rope 3 and the descent position of the handle 5. Between these two positions of the handle, it is particularly advantageous to provide for the cam 2 to remain in its clamping position of the rope 3. This embodiment is illustrated in FIGS. 3, 4 and 5 where it can be observed that movement of the handle 5 did not result in movement of the cam 2 through the observation aperture present in the second flange 9. This configuration is different from a functionality of "antipanic" type where the mechanical connection is interrupted when the user is descending and in particular when the mechanical connection is configured so that movement of the handle from its stowing position to the descent position does not have any effect on the cam. Once the handle has reached the descent position, the handle is mechanically connected to the cam 2 so that continued movement of the handle results in movement of the cam.

It possible to provide for an intermediate position to exist between the first position of the handle 5 which clamps the rope 3 and the descent position. In this intermediate position, the handle 5 is not mechanically connected to the cam 2 so that the cam 2 remains in its clamping position of the rope 3.

This configuration is advantageous as a force applied on the handle 5 and which may cause an involuntary movement of the handle 5 will not result in release of the cam 2 and therefore in an undesired descent of the user. In a first case, the force applied on the handle 5 will increase the clamping force of the cam 2 on the rope 3. In another case, the force applied on the handle 5 moves the handle 5 in the other direction. By mechanically disconnecting the handle 5 and cam 2, movement of the handle 5 does not have any incidence on clamping of the rope 3 by the cam 2, thereby enhancing safety.

The user therefore has to move the handle 5 by a predefined distance in order to reach the descent position where running of the rope 3 is possible. When the handle 5 reaches the descent position, a new mechanical connection takes place between the cam 2 and handle 5. The handle 5 comes into contact with the cam 2 so as to reduce the clamping force and allows running of the rope 3 along the running path. Movement of the handle away from the first position of the handle, for example by continuing the rotation of the handle, results in movement of the cam. The movement of the cam increases the distance separating the side wall of the cam and the side wall of the first flange which reduces the friction force applied on the rope 3. The rope 3 can then move increasingly easily and the user can control his rate of descent by controlling the friction force.

In a particular embodiment, the mechanical connection between the handle 5 and cam 2 is made in a second direction and advantageously only in the second direction.

If the user releases his grip on the handle 5, the spring 6 returns the handle 5 to the stowing position. As a rope 3 is inserted in the descender, the handle 5 will remain in the first position of use which will press on the cam 2 to enhance clamping of the rope 3. As an alternative, the handle 5 can remain in the intermediate position.

In an advantageous embodiment, the handle 5 is mounted rotating with respect to the first flange 1 which facilitates use of the descender. In order to increase safety, it is particularly advantageous to provide for the first position of use of the handle 5 to be located on one side of the descender and the descent position with running of the rope 3 to be located on the other side of the descender. The two sides are separated by inlet and outlet openings of the rope 3 in the descender. One of the two openings is associated with the strand of the rope 3 connected to the top point which is preferentially a fixed point. This rope strand 3 is taut which forms a natural barrier against numerous elements which could catch in the handle 5 and possibly cause a beginning of rotation of the handle.

In even more advantageous manner, the handle 5 is configured so that the first position of use clamping the rope 3 and the descent position are separated by an angle at least equal to 90°. The angle is measured in the plane of rotation of the handle 5. To reduce the risks even further, the first position of use clamping the rope 3 and the descent position are separated by an angle at least equal to 120°

In a particular embodiment, the cam 2 and handle 5 are separated by the first flange 1. This configuration is particularly advantageous as it makes insertion of the rope 3 in the running path defined by the first flange 1 easier to achieve.

In preferential manner illustrated in FIGS. 6, 7 and 8, the cam 2 is provided with or associated with a salient pin 7 collaborating with a stop 8 of the handle 5 which enables the mechanical connection between the two parts to be formed. The stop 8 of the handle 5 presents opposite first and second surfaces 8*a* and 8*b*. The pin 7 is in contact with the first surface 8*a* of the stop 8 when the cam 2 is located between its stowing position and its clamping position of the rope 3. In this way, it is particularly easy to obtain an intermittent mechanical contact between the cam 2 and handle 5. In the illustrated example, the stop 8 is represented as a single solid part. However, as an alternative, the stop can be hollow and/or formed by several different component parts.

As an alternative, the handle 5 can comprise a pin 7 which operates in conjunction with a stop 8 of the cam 2.

It is also advantageous to provide for the pin 7 to be in contact with the second surface 8*b* of the stop 8 when the handle 5 is in its descent position. In this configuration, the stop 8 rotates around the swivel pin of the handle 5 so as to push the pin 7 thereby moving the cam 2. This embodiment is very advantageous as it is particularly efficient and compact.

In an alternative embodiment, the pin 7 does not have any contact with the stop 8 when the handle 5 is located between the first position of use clamping the rope 3 and the descent position. Such a result can be obtained by modifying the shape of the stop 8 so that a functional clearance exists between the pin 7 and stop 8 when the stop 8 is moved in rotation.

In advantageous manner, the pin 7 passes through the first flange 1. Movement of the pin 7 is demarcated by an opening having opposite first and second ends. The opening is formed in the first flange 1. The pin 7 is in contact with the first end when the handle 5 is in the stowing position. This configuration makes it possible to fix the minimum distance which exists between the side wall of the cam 2 and the side wall 4 of the first flange 1 defining the running path of the rope 3. By defining this minimum distance, it is easier for the user to insert the rope 3 without forcing on the cam when the user is wearing gloves.

In a particular embodiment that is not represented, it is possible to use a second spring which is connected to the cam 2 and to the first flange 1 in order to return the cam 2 to its stowing position. In advantageous manner, the stiffness of the second spring is lower than the stiffness of spring 6. As an alternative, it is also possible to provide for the stiffness of the second spring to be greater than the stiffness of the spring 6. This embodiment enables clamping of the rope 3 to be heightened when the handle 5 is located between its clamping position and the descent position, but insertion of the rope 3 between the cam 2 and first flange 1 is more difficult.

Use of the self-locking descender can take place in the following manner. A descender according to one of the different embodiments described in the foregoing is provided. The descender can be presented closed (FIG. 1) or open (FIG. 2). A rope 3 is inserted in the first flange 1 so as to move the cam 2 from a stowing position to a clamping position of the rope 3 (FIG. 3). It is advantageous to close the descender by means of the second flange (FIG. 4). Movement of the cam 2 results in movement of the handle 5 from a stowing position to a first position of use clamping the rope 3. The handle 5 is moved from its first position of use clamping the rope 3 to a descent position which allows running of the rope 3. The cam 2 is not mechanically connected to the handle 5 during this movement between the first position of use and the descent position. As indicated in the foregoing, movement of the handle from the first position of use to the descent position does not modify the separating distance between the side wall of the cam and the side wall of the first flange, i.e. it does not modify the load applied on the rope 3.

In one embodiment, the second flange 9 is securedly united to the first flange 1. The second flange 9 is preferentially mounted movable in rotation around the swivel pin 9*a* which is fixed to the first flange. Rotation of the second flange 9 enables the descender to be opened or closed to enable or disable insertion or extraction of the rope.

In advantageous manner, the movement of the second flange 9 with respect to the first flange 1 is blocked by the swivel shaft 2*a* and cam 2 and/or by the swivel shaft 5*a* of the handle 5 to define the closed position of the descender.

In the illustrated embodiment, the first flange 1 comprises a closed opening designed for fixing of the connector connecting the descender to the user, for example a carabiner. The second flange 9 also comprises an opening which is closed by means of a movable closing member 10.

The invention claimed is:

1. Self-locking descender for a rope comprising:

a first flange provided with a side wall defining a running path of the rope, the first flange defining a pass-through opening having opposite first and second ends, a cam mounted movable with respect to the first flange to successively define a first cam position where a side wall of the cam is separated from the side wall of the running path of the rope by a first distance, a second cam position where the side wall of the cam is separated from the side wall of the running path of the rope by a second distance greater than the first distance and a third cam position where the side wall of the cam is separated from the side wall of the running path of the rope by a third distance greater than the second distance, the cam blocking the rope against the side wall of the miming path of the rope, a handle mounted movable in rotation with respect to the first flange to successively define a stowing position, a first position of the handle and a second position of the handle, the handle being movable in a first direction and in a second opposite direction, the handle having first and second opposite faces, a salient pin mounted fixed to the cam, the salient pin passing through the first flange via the pass-through opening and moving from the first end to the second end, the pass-through opening blocking the cam between the first cam position and the third cam position, the salient pin having first and second opposite faces, a stop cooperating with the salient pin, the stop being mounted fixed on the handle so as to move in rotation with the handle, wherein in a first position, a first face of the stop is in contact with the first face of the salient pin, and wherein in a second position, a second face of the stop is in contact with the second face of the salient pin, the second face of the stop being opposite the first face of the stop, a first spring connected to the first flange and to the handle, the first spring applying a force on the handle to cause rotation of the handle from the second position to the stowing position, wherein when the handle is in the stowing position, the first face of the stop applies a force pushing the salient pin against the first end of the pass-through opening, and when moving the handle in the first direction from the stowing position, the handle releases a contact between the first face of the stop and the first face of the salient pin until the second face of the stop is in contact with the second face of the salient pin, the stop pushing the salient pin toward the second end of the pass-through opening.

2. Descender according to claim 1 wherein the handle is mounted movable in rotation with respect to the first flange and wherein the first position of the handle is located on one side of the descender and the second position of the handle is located on the other side of the descender, the two sides being separated by inlet and outlet openings of the rope in the descender.

3. Descender according to claim 2 wherein the first position of the handle and the second position of the handle are separated by an angle at least equal to 90°.

4. Descender according to claim 3 wherein the first position of the handle and the second position of the handle are separated by an angle at least equal to 120°.

5. Descender according to claim 1 wherein the salient pin is in contact with the second surface of the stop when the handle is in the second stop position.

6. Descender according to claim 1 wherein the salient pin does not have any contact with the stop when the handle is located between the first position of the handle and the second position of the handle.

* * * * *